United States Patent [19]

Cacho

[11] Patent Number: 4,548,409

[45] Date of Patent: Oct. 22, 1985

[54] GAME WITH SLIDABLE DISCS, GOAL POCKETS, AND RAIL TRAPS

[76] Inventor: Jaime A. Cacho, 488 Richmond Rd., Cleveland, Ohio 44143

[21] Appl. No.: 459,811

[22] Filed: Mar. 2, 1983

[51] Int. Cl.[4] ..... A63F 3/00

[52] U.S. Cl. ..... 273/126 R

[58] Field of Search ..... 273/126 R, 3 B, 12, 273/3 R, 88, 85 R, 113, 115, 116, 123 R, 126 R

[56] References Cited

U.S. PATENT DOCUMENTS

| | | | |
|---|---|---|---|
| 574,027 | 12/1896 | Gallsworth | 273/3 R |
| 809,853 | 1/1906 | Silvernail | 273/123 R |
| 1,349,587 | 8/1920 | Smith et al. | 273/126 R |
| 1,492,127 | 4/1924 | Fox et al. | 273/88 |
| 2,344,737 | 3/1944 | Schlesinger | 273/126 R |
| 3,947,035 | 3/1976 | Buchard | 273/126 R |
| 4,146,228 | 3/1979 | Laciste | 273/126 R |

FOREIGN PATENT DOCUMENTS

| | | | |
|---|---|---|---|
| 2097682 | 10/1982 | United Kingdom | 273/126 R |

*Primary Examiner*—Richard C. Pinkham
*Assistant Examiner*—T. Brown
*Attorney, Agent, or Firm*—Harlan E. Hummer

[57] ABSTRACT

A game that uses a gameboard which has a flat, smooth playing surface over which flat discs are slidable. A bumper rail borders the playing surface and causes discs to carom or ricochet back onto the playing surface. A plurality of pockets are disposed in the playing surface adjacent the bumper rail. The pockets are recessed into the playing surface, so that a disc will fall, by gravity, into the pockets. The pockets are made escape-proof by undercutting the bumper rail adjacent the pockets to extend the pockets under a part of the bumper rail. Thus, a part of the bumper rail overhangs each of the pockets and acts to prevent a disc from hitting the bumper rail and rebounding back over the pockets. The underside of the overhanging portions of the bumper rail, or the backsides thereof which the discs strike, may be sloped to deflect the discs downwardly into the pockets. The playing surface can be made to slightly overhang each of the pockets to help prevent the escapement of discs from the pockets. Unique traps are provided in the bumper rails between the pockets of at least two opposing sides of the playing surface.

12 Claims, 4 Drawing Figures

GAME WITH SLIDABLE DISCS, GOAL POCKETS, AND RAIL TRAPS

BACKGROUND OF THE INVENTION

The invention is an improvement in the old game of Carom which, similar to the game of U.S. Pat. No. 3,547,443, uses a gameboard which has a rectangular playing surface that is bounded by a bumper rail. Pockets are located in the four corners of the playing surface to receive playing discs which are shot into the pockets by means of a master cue disc which is struck and propelled by a cue stick in the hands of a player. The original games of this type were made entirely of wood. A thrilling new dimension was added with the advent of lightweight, highly polished materials such as plastic and aluminum. The playing surface became a slippery surface over which lightweight discs moved with lightening speed. In fact, the discs moved so quickly that players had to slow down hitting the discs in order to pocket them. This detracts from the thrill of the game.

One aspect of the invention solves this problem by the provision of escape-proof pockets. Another aspect of the invention is directed to the provision of a novel feature for trapping discs on the gameboard to hinder an opponent's play, thereby enhancing the suspense of playing the game and the skill of the players in manipulating the discs on the playing surface of the gameboard.

Briefly stated, the invention is in a game which employs a gameboard that has a flat, smooth playing surface that is bounded by a bumper rail which extends upwardly from the plane of the playing surface, when the surface is in a horizontal plane. A plurality of pockets are strategically spaced around the playing surface for receiving flat discs used in playing the game. Means are provided for preventing the escapement of discs from the pockets, including means for extending the pockets into the bumper rail adjacent the pockets so that a forceably shot disc traveling at a high speed, will pass partially under the bumper rail before striking the rail and falling into the pocket. At least one trap is provided between at least one pair of pockets. The trap has a disc supporting surface which is flush with the playing surface and is located on the gameboard such that extreme care must be taken by a player in shooting an opponent's disc into the trap to win the game, depending on the rules under which the game is being played. Also provided are means for facilitating hitting the master cue disc with a cue stick, when the cue disc comes to rest in close proximity to the bumper rail, and means for mounting the gameboard for rotation so that a player can continue shooting in approximately the same location.

DESCRIPTION OF THE DRAWINGS

The following description of the invention will be better understood by having reference to the accompanying drawings, wherein.

ENVIRONMENT OF THE INVENTION

Figure 1:
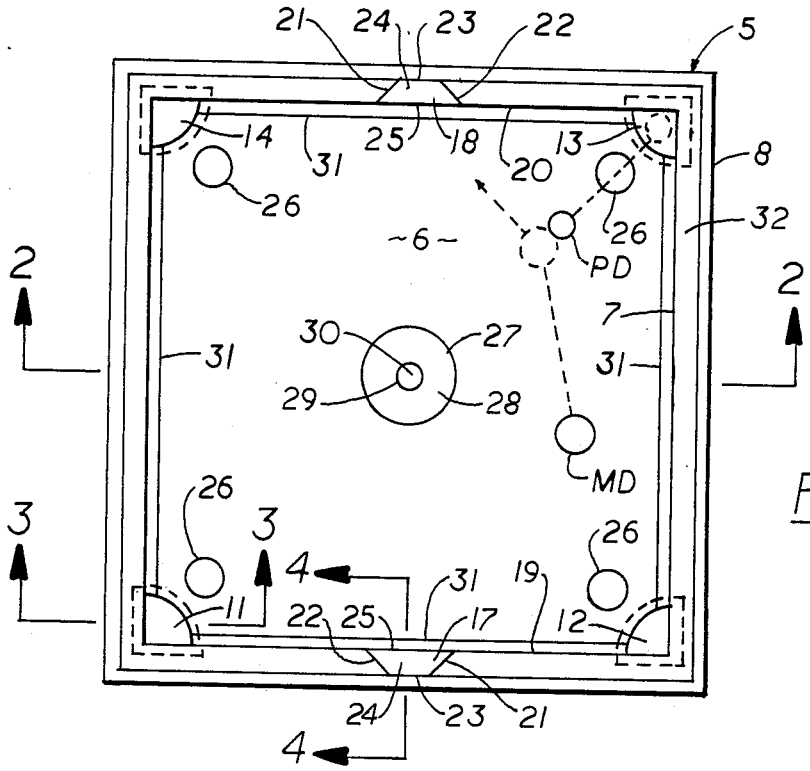
FIG. 1 is a plan view of a gameboard of the invention.
Figure 2:
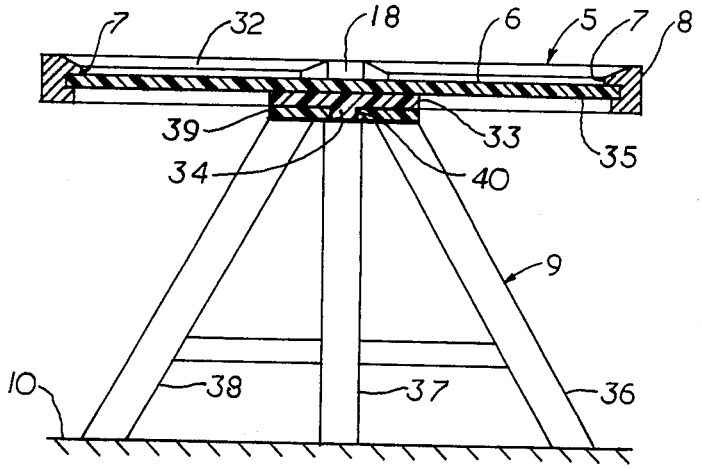
FIG. 2 is a section of the gameboard viewed from the line 2—2 of FIG. 1.

With general reference to the drawing for like parts and particular reference to FIGS. 1 and 2, there is shown a gameboard 5 which comprises a flat, smooth playing surface 6 that has an outer peripheral edge 7 which may be any suitable shape, e.g. circular or rectangular, depending on the play desired. In this instance, the playing surface is rectangular, preferably square, and bounded at its peripheral edge 7 by a continuous bumper rail 8 which acts as, a finished rim around the gameboard 5, a support for the cue stick CS in certain shots, and a rail which either the cue or master disc MD, or a regular playing disc PD can strike and rebound therefrom. The playing surface 6 is composed of any suitable material which is hard, smooth, and highly polished, such as a plastic bearing the trademark Formica. The discs and bumper rail are preferably hard and rigid, e.g. metal, plastic, or hardwood, so that a sharp cracking sound will be heard when a disc strikes the bumper rail 8. Such noise has ear appeal and adds excitement to a well executed, fast shot.

The gameboard 5 is mounted atop a platform 9 which is designed to hold the gameboard 5 and playing surface 6 in a horizontal plane in predetermined spaced relation from a sturdy support, such as the floor 10 of a gameroom.

Figure 3:
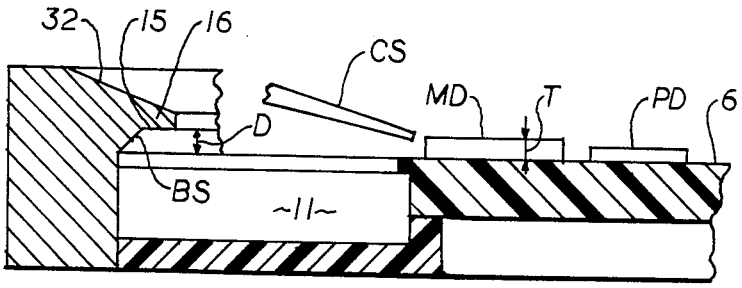
FIG. 3 is an enlarged section of the gameboard viewed from the line 3—3 of FIG. 1.
Figure 4:
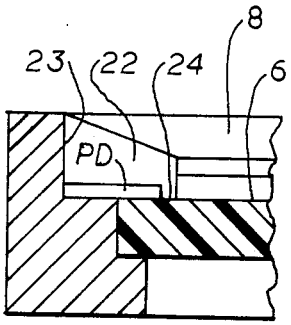
FIG. 4 is an enlarged section of the gameboard viewed from the line 4—4 of FIG. 1.

A plurality of pockets 11–14 are strategically spaced around the peripheral edge 7 of the playing surface 6 for receiving the playing discs PD as they are shot into the pockets 11–14. In this case, the pockets 11–14 are recessed in the playing surface 6 adjacent the four corners of the surface which is at the four inside corners of the bumper rail 8. The pockets extend below the plane of the playing surface 6, as best seen in FIG. 3. A player uses a cue stick CS to strike the master disc MD and propel it into one of the playing discs PD at an angle sufficient to drive the playing disc into one of the pockets 11–14 (note dotted line movement of discs in FIG. 1).

THE INVENTION

In one aspect of the invention, the bumper rail 8 is undercut adjacent each of the pockets 11–14, as best seen from FIG. 3 and shown in dotted line in FIG. 1. The underside 15 of the bumper rail 8, adjacent each of the pockets 11–14, is spaced above the the playing surface 6, a distance D which is slightly greater than the thickness T of the master disc MD which, in turn, has a thickness and diameter that are greater than those of the playing discs PD. Thus, both discs, if forcibly struck hard enough, can at least pass partially under the portion 16 of the bumper rail 8 which overhangs each of the pockets 11–14, before striking the bumper rail 8. The overhanging portions 16 of the bumper rail 8 can have their undersides 15 and backsides BS sloped to direct or deflect the discs downwardly into the pockets 11–14 to insure that the discs will not escape from the pockets, when they enter the pockets at a high rate of speed. The upper, flat playing surface 6, as best seen in FIG. 3, is made to slightly overhang each of the pockets 11–14 to help prevent the escapement of discs from the pockets.

The pockets 11–14, as best seen in FIG. 1, are quarter segments of a circle or cylinder, depending on the depth of viewpoint in looking at the pockets 11–14. They are sufficiently large to permit entry of the larger master disc MD.

In another aspect of the invention, a plurality of traps 17,18 are strategically located adjacent the outer peripheral edge 7 of the playing surface 6. The traps 17,18 can be formed by lines printed on the playing surface 6 within the bumper rail 8, but better results and more excitement are achieved by recessing the traps 17,18 inwardly of the bumper rail 8 on opposite sides 19,20 of the playing surface 6, midway between adjacent pairs of pockets 11,12 and 13,14. The traps 17,18 each have a pair of opposing sidewalls 21,22 which converge in a direction away from the playing surface 6, and which have their innermost ends, farthest spaced from the playing surface 6, connected by a backwall 23 which parallels the adjacent sides 19,20 of the playing surface 6. The sidewalls 21,22 of each of the traps 17,18 are at angles of 45 degrees to a plane which bisects the playing surface 6 and the included angle of 90 degrees between the sidewalls 21,22. The traps 17,18 each have a disc supporting surface 24 which is flush with the playing surface 6. A frontline 25 spans the frontside of each of the traps 17,18, which are open to the playing surface 6, so that a playing disc PD is free to enter the traps 17,18 from the playing surface 6. The distance of the frontline 25 to the backwall 23 of each of the traps 17,18, is about $1\frac{1}{4}$ to $1\frac{1}{2}$ times the diameter of the playing disc PD. A playing disc PD which comes to rest within the traps 17,18 without touching the frontline 25, is said to be "trapped". Because of the particular configuration of the traps 17,18, a playing disc PD must be carefully shot into the traps 17,18. Otherwise the playing discs PD will ricochet out of the traps 17,18.

Any suitable indicia can be placed on the playing surface 6 to direct play of the game. For example, a master spot circle 26 on which the master disc MD is spotted to initiate play in the game, or after a scratch, as will hereinafter be explained, is located on the playing surface 6 in predetermined spaced relation from each of the pockets 11–14 in diagonal alignment with the inside corners of the bumper rail 8 and the center of the playing surface 6. The master circles 26 are, naturally, the same size as the master disc MD. A large diameter circle 27 is at the center of the playing surface 6 and defines a spot or scratch area 28 which is large enough to hold sixteen playing discs PD in random or specially aligned order, since sixteen playing discs PD are used in most variations of the game of TRAPPOOL TM. A smaller diameter circle 29, the size of a playing disc PD, is concentric within the larger diameter spot circle 27 and defines a spot 30 on which a scratched playing disc PD is spotted for replay.

An inch line 31 is placed on the playing surface 6 in parallel relation to the bumper rail 8 along each side of the playing surface 6. It is sometimes difficult to strike the master disc MD with a cue stick CS, when the master disc MD comes to rest against the bumper rail 8, or in close proximity to the bumper rail 8. When this happens, a player has the option of inching the master disc MD into the playing surface 6, until it just clears the adjacent inch line 31. Thus, the master disc MD is repositioned to more easily hit it with a cue stick CS. The spacing of the inch lines 31 from the bumper rail is dependent upon the size of the playing surface 6 and the size and height of the bumper rails above the playing surface. The top portion 32 of the bumper rail 8 closest the playing surface 6, is sloped downwardly in the direction of the playing surface 6 to facilitate hitting the master disc MD with the cue stick CS.

A typical game of TRAPPOOL uses sixteen playing discs, numbered consecutively from one to sixteen. The first eight playing discs PD are colored red and the last eight discs are colored black. All sixteen playing discs PD are initially placed within the spot area 28 in random or selected order. The first player to shoot, spots the master disc MD on any of the master spot circles 26 to start the game. Like pocket billiards, the group of playing discs PD are broken up by driving the master disc MD into an area of the group in hopes that one of the playing discs PD will be pocketed. The first player continues shooting so long as he or she pockets at least one playing disc per shot. The first player's turn ends when a playing disc PD is not pocketed. A game, similar to "eight ball" in pocket billiards, is played by two players, or two teams of players, who try to pocket the differently colored playing discs PD. The first player to pocket a playing disc PD, must continue pocketing the same colored discs. If two or more differently colored discs are pocketed on the break, then the player's turn ends and he or she must return one of the selected colored playing discs PD to the spot 30. If the spot 30 is at least partially occupied by another disc, then the disc being spotted, can be placed anywhere within the spot area 28. The first player to pocket all of his or her colored playing discs wins the game. Like pocket billiards, scratches occur when one of the discs flies off the gameboard 5, or an opponent's playing disc PD is intentionally or accidently pocketed. In the latter case, the opponent's disc remains pocketed and the player's turn ends. If a playing disc PD leaves the gameboard 5, the disc is returned to the spot, as previously described, and the player's turn ends. If the master disc MD leaves the gameboard 5, the player's turn ends and the master disc MD is returned to the master circle 26 closest to the point where the disc left the playing surface 6. If this particular master circle 26 is partially occupied by another disc, then the master disc MD is inched into the master circle from the unoccupied portion of the master circle until the interfering disc is displaced from the master circle. If the particular master circle is fully occupied by another disc, then the master disc is inched into the master circle from the diagonal direction of the closest pocket.

The traps 17,18 come into play as follows. The lowest and highest numbered playing discs PD are designated as "trappable discs". At any time during the game, a player can shoot an opponent's trappable disc into one of the traps 17,18 providing, of course, that the opponent's trappable disc is unpocketed. A player who traps an opponent's trappable disc automatically wins the game. It can be appreciated that this novel trap feature adds a new and exciting dimension to the game and skill of playing it. A less strict rule would be to allow an opponent with a trapped disc, one shot to free the disc or lose the game. It should also be understood, that during the course of the game, any other of the opponent's playing discs can be trapped to hinder subsequent play of the opponent. However, a player's turn ends when an opponent's playing disc, trappable or otherwise, is shot into one of the traps 17,18. Like pocket billiards, variations of TRAPPOOL can be played, such as straight TRAPPOOL where the playing discs must be pocketed in numerical order, or any disc any pocket TRAPPOOL where any disc can be shot, but the pocket in which the disc is shot must be named in order to get credit for the pocketed disc. In such games, the traps 17,18 can be used to eliminate the next succeeding player, if more than two players are involved.

To facilitate playing the game in areas cramped for space, the gameboard 5 is mounted on the platform 9 for rotation about a vertical axis by any suitable means. For example, a bottom plate 33 with a downwardly directed attached dowel 34, is centrally secured on the underside 35 of the gameboard 5. The platform 9 comprises a plurality of support legs 36–38 to which is fastened a top plate 39 with a center opening 40 for rotatably receiving the dowel 34. The friction between the engaged bottom and top plates 33 and 39, stabilizes the gameboard 5 and prevents its rotation, unless a force is applied. Any suitable means other than friction, such as engaging detents and indents, can be used to prevent rotation of the gameboard 5 while a player is shooting.

Thus, there has been described, a TRAPPOOL game with a novel trap feature for enhancing play of the game. Further, the pockets are specially configured to prevent escapement of discs from the pockets. Other features, such as the indicia on the board to direct plays of the game, the sloping of the bumper rails to enhance hitting the master disc, and the rotatable gameboard, are designed to add pleasure and excitement to the game. A gameboard of about four foot square has been found especially suitable for play in most rooms. The gameboard can be readily removed from its supporting platform and easily stored and set-up.

What I claim is:

1. An apparatus used in playing a game, comprising:

(a) a gameboard having a flat, smooth playing surface across which flat discs, used in playing the game, are slidable, the playing surface being bounded by an outer, peripheral edge;

(aa) a master disc and a plurality of playing discs used in playing the game, the master disc being larger than the playing discs and used to strike and propel the playing discs across the playing surface;

(b) a continuous bumper rail at the peripheral edge of the playing surface and extending vertically above the plane of the playing surface, when said surface is in a horizontal plane for playing the game, so that a disc, sliding across said surface and attempting to leave said gameboard, will strike said bumper rail and rebound therefrom;

(c) a plurality of pockets strategically located around the peripheral edge of the playing surface adjacent the bumper rail for receiving and holding discs shot therein, each of the pockets being sized larger than the master disc and being recessed below the playing surface, so that a slowly moving disc, upon entering the pocket, will fall, by gravity, into the pocket;

(d) means associated with each of the pockets for preventing fast moving discs from escaping the pockets once they are shot therein; and (e) at least one trap disposed adjacent the peripheral edge of the playing surface between a pair of pockets, the trap being recessed inwardly of the bumper rail in a direction away from the center of the playing surface such that the bumper rail is removed in the area of the trap which has a disc supporting surface which is flush with the playing surface, the trap being partially formed by adjacent walls of the bumper rail, which walls, in the area of the trap, are substantially normal to the plane of the playing surface, so that a disc can rebound from said walls and not become wedged therein, the walls of the bumper rail in the area of the trap including, (i) a pair of opposing sidewalls which extend from the center of the playing surface in converging relation into the bumper rail, (ii) a backwall connecting the ends of the sidewalls farthest from the center of the playing surface, and (iii) a line disposed on the playing surface and connecting the ends of the sidewalls closest the center of the playing surface, each trap being sized and shaped and so disposed on the gameboard that a disc, entering the trap, can escape therefrom if improperly shot too fast into the trap, and, if resting in the trap, can be knocked therefrom upon contact with another disc entering the trap.

2. The game apparatus of claim 1, wherein the line and backwall are parallel and the distance between them is not greater than one and one-half times the diameter of a playing disc, and the included angle between planes containing the sidewalls is substantially ninety degrees.

3. The game apparatus of claim 2, wherein the means (d) for preventing the escapement of discs from the pockets includes, undercutting the bumper rail adjacent the pockets to extend the pockets partially under the bumper rail, so that a disc, entering any one of the pockets at a high rate of speed, will pass partially under a portion of the bumper rail overhanging the pocket, before striking the bumper rail and rebounding into the pocket.

4. The game apparatus of claim 3, which includes, means closely spaced to each of the pockets in alignment between each of the pockets and the center of the playing surface, for spotting on the playing surface, the master disc that is used to hit and propel the other, smaller diameter playing discs used in playing and scoring the game, and means at the center of the playing surface for spotting on the playing surface, playing discs.

5. The game apparatus of claim 4, wherein the playing surface is rectangular and a pocket is located in each of the four corners thereof.

6. The game apparatus of claim 5, which includes a pair of traps in a pair of opposing sides of the bumper rail midway between adjacent pairs of pockets.

7. The game apparatus of claim 6, which includes, a platform for supporting the gameboard, and means for detachably mounting the gameboard on the platform for rotation about a vertical axis, when the gameboard is in a horizontal plane.

8. An apparatus used in playing a game, comprising:

(a) a gameboard having a flat, highly polished rectangular playing surface across which flat discs, used in playing the game, are slidable;

(b) a bumper rail bordering the playing surface and extending vertically above the playing surface, when the playing surface is in a horizontal plane for playing the game, so that a disc, sliding on the playing surface and attempting to leave the gameboard, will strike, and rebound from, the bumper rail which has an upper, top portion, closest the playing surface, which is sloped downwardly in the direction of the playing surface to facilitate hitting a disc with a cue stick in the hands of a player of the game;

(c) a pocket disposed in each of the four corners of the playing surface, the pockets being recessed downwardly of the playing surface so that a disc, entering any one of the pockets at a slow rate of speed, will fall, by gravity, into the pocket, each of the pockets being a segment of a circle at the playing surface;

(d) means for preventing escapement from the pockets of discs entering the pockets at a speed sufficient to cause the discs to rebound from the bumper rail bordering the pockets, said means including undercutting the bumper rail bordering the pockets to extend the pockets partially under the bumper rail, so that a disc can pass partially under a portion of the bumper rail overhanging the pocket, before striking the bumper rail and rebounding into the pocket;

(e) a plurality of flat playing discs used in playing and scoring the game;

(f) at least one master disc which is larger, in diameter, than the playing discs, the master disc being used to hit the playing discs into the pockets;

(g) means adjacent each of the pockets in diagonal alignment between the pockets and center of the playing surface, for spotting on the playing surface at certain times, the master disc;

(h) means at the center of the playing surface for spotting on the playing surface at certain times, a single playing disc;

(i) a spot area surrounding the playing disc spotting means (h) and concentric therewith and in which a number of playing discs, used in playing the game, are arranged to initiate playing the game; and (j) a pair of traps cut into opposing bumper rails midway between adjacent pockets, such that the bumper rails are removed in the areas of the pockets, each of the traps having a disc supporting surface which is flush with the playing surface, each of the traps defined by, (i) a pair of bumper rail sidewalls which converge in a direction away from the center of the playing surface, (ii) a bumper rail backwall which extends between, and connects, ends of the sidewalls farthest from the center of the playing surface, and (iii) a line connecting ends of the sidewalls closest the center of the playing surface, the sidewalls and backwall of each trap being substantially normal to the playing surface so that a disc will rebound therefrom and not become wedged thereunder, each of the traps being sized so that, (I) a disc can escape from the trap if it is improperly shot too fast into the trap, and (II) a disc, resting in the trap, can be knocked therefrom by another disc entering the trap.

9. The game apparatus of claim 8, wherein portions of the bumper rail overhanging the pockets each have an underside which is in predetermined spaced relation from the plane of the playing surface a distance that is slightly greater than the thickness of the master disc, and which is sloped to deflect the discs downwardly into the pockets.

10. The game apparatus of claim 8, wherein portions of the bumper rail overhanging the pockets each have a backside which a disc strikes when it passes under the overhanging portions, each backside being sloped to deflect discs downwardly into the pockets, when the playing surface is in a horizontal plane.

11. The game apparatus of claim 8, wherein the discs and playing surface and the bumper rail are composed of material from the group consisting of of plastic, wood and metal.

12. The game apparatus of claim 8, which includes means for mounting the gameboard for rotation about the center axis of the playing surface.

* * * * *